US011131112B2

(12) United States Patent
Frankel et al.

(10) Patent No.: US 11,131,112 B2
(45) Date of Patent: Sep. 28, 2021

(54) EXPANDABLE CANOPY TENT FRAME

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 0 days.

(21) Appl. No.: 16/794,511

(22) Filed: Feb. 19, 2020

(65) Prior Publication Data

US 2021/0254364 A1 Aug. 19, 2021

(51) Int. Cl.

| | |
|---|---|
| ***E04H 15/50*** | (2006.01) |
| ***E04H 15/58*** | (2006.01) |
| ***A45B 19/12*** | (2006.01) |
| ***E04H 15/34*** | (2006.01) |
| ***E04F 10/04*** | (2006.01) |
| *A45B 23/00* | (2006.01) |

(52) U.S. Cl.

CPC ..... *E04H 15/50* (2013.01); *A45B 19/12* (2013.01); *E04F 10/04* (2013.01); *E04H 15/34* (2013.01); *E04H 15/58* (2013.01); *A45B 2023/0056* (2013.01); *Y10S 160/905* (2013.01)

(58) Field of Classification Search

CPC ..... E04H 15/50; E04H 15/34; E04H 15/58; A45B 19/12; A45B 2023/0056; E04F 10/04; Y10S 160/905

USPC ..... 135/20.1, 25.2, 117, 122, 131, 145; 297/184.15; 52/74, 109; 160/22, 39, 79, 160/905

See application file for complete search history.

(56) References Cited

U.S. PATENT DOCUMENTS

| | | | | | |
|---|---|---|---|---|---|
| 186,583 | A * | 1/1877 | Lathrop | E04H 15/50 | 135/145 |
| 204,187 | A * | 5/1878 | Bloom | E04H 15/50 | 135/145 |
| 204,243 | A * | 5/1878 | O'Sullivan | A47C 29/006 | 135/90 |
| 612,479 | A * | 10/1898 | Casey | A47G 25/746 | 211/105 |
| 923,021 | A * | 5/1909 | Condon | B62B 9/14 | 135/88.02 |
| 1,076,310 | A * | 10/1913 | Pennington | E04F 10/0614 | 160/69 |
| 1,257,535 | A * | 2/1918 | Sampson | E04H 15/50 | 135/145 |
| 1,301,619 | A * | 4/1919 | Szemanski | B60J 7/1265 | 296/107.09 |

(Continued)

FOREIGN PATENT DOCUMENTS

| | | | |
|---|---|---|---|
| CN | 2600529 Y | * | 3/2003 |
| CN | 20187619 Y | * | 9/2008 |

*Primary Examiner* — Robert Canfield
(74) *Attorney, Agent, or Firm* — Merek, Blackmon & Voorhees, LLC

(57) ABSTRACT

An expandable canopy tent frame includes two sets of four-bar linkage with overlapping and staggered central axial lines. The central axial hinge point and the side edge hinge point of the two linkage sets are aligned. The central axial hinge points have a lateral bar. The two ends of the lateral bar pass through the slide bushings on the side edge hinge points, and the slide bushings form the support with both sides of the lateral bar. The main structure has at least one fixed end and can be fixed on objects by utilizing that fixed end.

10 Claims, 5 Drawing Sheets

(56) References Cited

U.S. PATENT DOCUMENTS

| | | | | |
|---|---|---|---|---|
| 1,712,836 | A * | 5/1929 | Mills | E04H 15/06 135/145 |
| 3,868,961 | A * | 3/1975 | Sternis | A01G 9/22 135/145 |
| 4,601,301 | A * | 7/1986 | Hermanson | A45B 19/06 135/145 |
| 4,846,204 | A * | 7/1989 | Sok Kyu | E04H 15/324 5/113 |
| 7,648,196 | B2 * | 1/2010 | Degel man | A47C 7/66 297/45 |
| 9,080,374 | B2 * | 7/2015 | Gavish | E04F 10/0651 |
| 9,533,558 | B2 * | 1/2017 | Suh | B60J 11/04 |
| 9,840,837 | B1 * | 12/2017 | Matsuoka | E04H 15/50 |
| 10,006,195 | B2 * | 6/2018 | Matsuoka | A01K 1/03 |
| 10,267,031 | B2 * | 4/2019 | Matsuoka | E04C 3/02 |
| 2005/0016692 | A1 * | 1/2005 | Glaser | B60J 11/00 160/22 |
| 2015/0300040 | A1 * | 10/2015 | Lopez Serrano | E04H 15/48 135/139 |
| 2015/0300560 | A1 * | 10/2015 | Matsuoka | A63H 33/00 362/427 |

* cited by examiner

EXPANDABLE CANOPY TENT FRAME

BACKGROUND OF THE INVENTION

Field of the Invention

This is in the field of tent frames, and consists of a type of canopy tent frame. In particular, it makes use of the expandable and foldable functions of four-bar linkage structures.

Technical Background

Most of the existing canopies and tents with expandable structures utilize four-bar linkage structures to achieve larger ranges of expandable functions. A four-bar linkage structure is consisted of two pairs of cross-hinged bars. The central axial line has a central axis hinge point. The edges of the two sides have side-edge hinge points. The expansion range is the greatest in the central axial direction. A four-bar linkage structure as mentioned above allows it to expand in multiple folds.

For example, Chinese patent CN03239557.4 shows a type of straight expandable shop entrance canopy. It has a least two four-bar linkage support arms. The linkage pivots on the inner ends of the four-bar linkage support arms are hinged to a stable installation base. The movable ends of the bars are locked onto the slots, and can move along the slots to expand or contract the four-bar linkage support arms. The sun canopy is installed on the four-bar linkage support arms. Lateral support bars can be installed among the aforementioned four-bar linkage arms. And in that structure, the four-bar support arms are distributed vertically so as mainly to support the sun canopy and the lateral support bars. However, it blocks the user's vision on two sides. This is the shortcoming of this type of technology.

And in another example, CN200820145436.X disclosed a type of sun tent device for cars. It includes a fixed support frame, a motor, an expandable support frame, and a shade cloth. The fixed support frame is installed on the top of a car. The fixed support frame has an expandable support frame that can expand forwards or backwards. The expandable support frame is constructed by cross-hinging certain pairs of cross bars, and is then hinged end-to-end in order. The motor drives the expandable support frame to allow it to expand and move. The two ends of the shade cloth are individually fixed on two ends of the expandable support frame and can open or close according to the expansion of the expandable support frame. The expandable function is achieved by end-to-end hinging of the cross bars to form a four-bar linkage structure. However, for end-to-end hinging to maintain the expandable support frame in its suspended position, there is a high rigidity requirement for the hinge points on both sides. In addition, problems such as deflection tend to occur at the hinge point of the two cross bars, i.e., the central axis pivot point, resulting in poor wind resistance.

One objective of this invention is to overcome current technological shortcomings and to provide a type of expandable canopy tent frame with a strong support and with no side visibility blockage.

SUMMARY OF THE INVENTION

The purpose of this invention is to provide a type of expandable canopy tent frame with two sets of four-bar linkage that are stagger-hinged to form an expandable main structure and with cross bars to support the width of the main structure.

The invention was accomplished in part by the following manner:

An expandable canopy tent frame includes four-bar linkage structure sets. Each of the four-bar linkage structure sets consists of two pairs of cross-hinged bars. The central axial line has a central axis hinge point. The edges of the two sides have the side edge hinge points. Its characteristics are: The main structure includes two sets of four-bar linkage with overlapping central axial lines; these are the first linkage set and the second linkage set. The aforementioned first linkage set and the second linkage set are staggered. The central axial hinge point of the first linkage set is aligned with the side edge hinge point of the second linkage set. The central axial hinge point of the second linkage set is aligned with the side edge hinge point of the first linkage set. The central axial hinge points have a lateral bar. The two ends of the lateral bar pass through the slide bushings on the side hinge points, and the slide bushings form the support with both sides of the lateral bar. The main structure has at least one fixed end and can be fixed on objects by utilizing that fixed end.

The fixed end of the main structure is a double-cross, bar structure. It has an upper cross bar and a lower cross bar that are locked as one structure. As mentioned above, the central axial hinge point of the first linkage set and the side edge hinge point of the second linkage set 10 are selectively positioned on the upper cross bar and the lower cross bar.

In the fixed end of the main structure, the lower cross bar is primary and the upper cross bar is secondary. The side linkage point and the second linkage set positioned by the lower cross bar is the primary bar set. The cross-section of bars that form the linkage set is preferably round. The first linkage set is the secondary bar set. The cross-section of this set and the two bars hinged to the upper cross bar are flat. All other bars have a round cross-section.

There are hinge points on the bars interconnected between the aforementioned first linkage set and the second linkage set.

The bars in the aforementioned first linkage set and second linkage set are curved. The upper cross bar and lower cross bar are parallel straight bars.

The bars in the aforementioned first linkage set and second linkage set are curved. The upper cross bar is also curved, and the curvature is similar to that of the bars in the first linkage set and the second linkage set, and they curve upward when contracted to the target position.

The fixed end of the main structure has a suspended structure. The suspended structure is one of the following: 1) A positioning plate with bolt holes. The positioning plate is fixed between the upper and lower cross bars, and the positioning plate is directly used to fix onto the surface of objects. 2) A plastic structure with insertion holes. The insertion holes of the plastic structure face downwardly and are fixed on the upper cross bar or the lower cross bar. The plastic structure is fixed on the upper ends of vertical bars. 3) It has a support bar, and a pair of plastic structures are fixed at symmetric positions of the upper cross bar of the lower cross bar. The back of each plastic structure has a curved slot, and the support bar is hinged to the lower end of the central axial line of the curved slot. The support bar can open outwardly and can fit into the curved slot to form a vertical stopper. When it closes inwardly, it can close with the lower cross bar together.

The side edge hinge point of the aforementioned second linkage set is positioned with the lower cross bar, which means it is fixed onto the lower cross bar with a bar bushing, and the two bar ends of the second linkage set hinge to their corresponding bar bushings. The bar bushings have elongated slots. They can move up and down relative to the lower cross bar and can adapt to the position change of the bar ends.

These cross bars are preferably round bars made of fiberglass.

This invention preferably utilizes two four-bar linkage sets that interlock with each other to form an expandable support. It has stronger rigidity, larger support surface and better wind resistance. Cross bars are positioned on hinge points that are aligned with the two sets. This provides support and positioning points to the cross bars and forms the structure for the two bar sets. The cross bars expands the width of the main structure to satisfy the needs of large shades, yet they can be closed together with the linkage sets when contracted to occupy less space.

BRIEF DESCRIPTION OF THE DRAWINGS

Similar reference characters denote corresponding features consistently throughout the attached drawings. Namely, in the drawings the following reference numbers refer to the following part.

Figure 1:
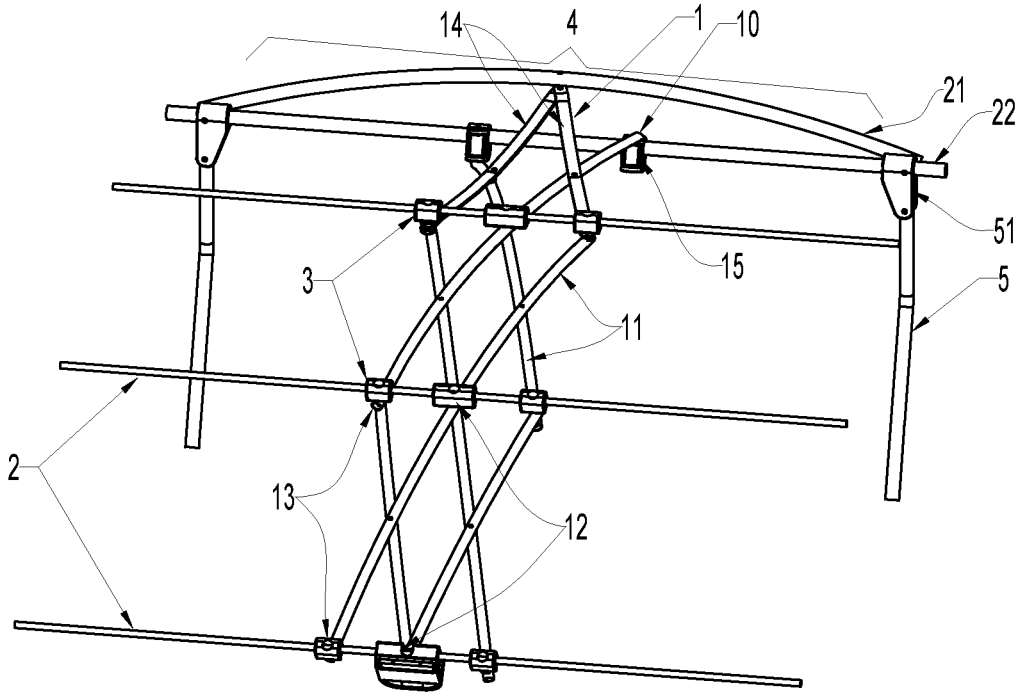
FIG. 1 shows the general appearance of expandable canopy tent frame.

1: First linkage set
10: Second linkage set
11: Bar
12: Central axial linkage point
13: Side linkage point
14: Flat bar
15: Bar bushing
151: Long slot
2: Cross bar
21: Upper cross bar
22: Lower cross bar
3: Slide bushing
4: Fixed point
5: Support bar
51: Plastic structure
52: Curved slot

DETAILED DESCRIPTION OF THE PREFERRED EMBODIMENT(S)

Figure 2:
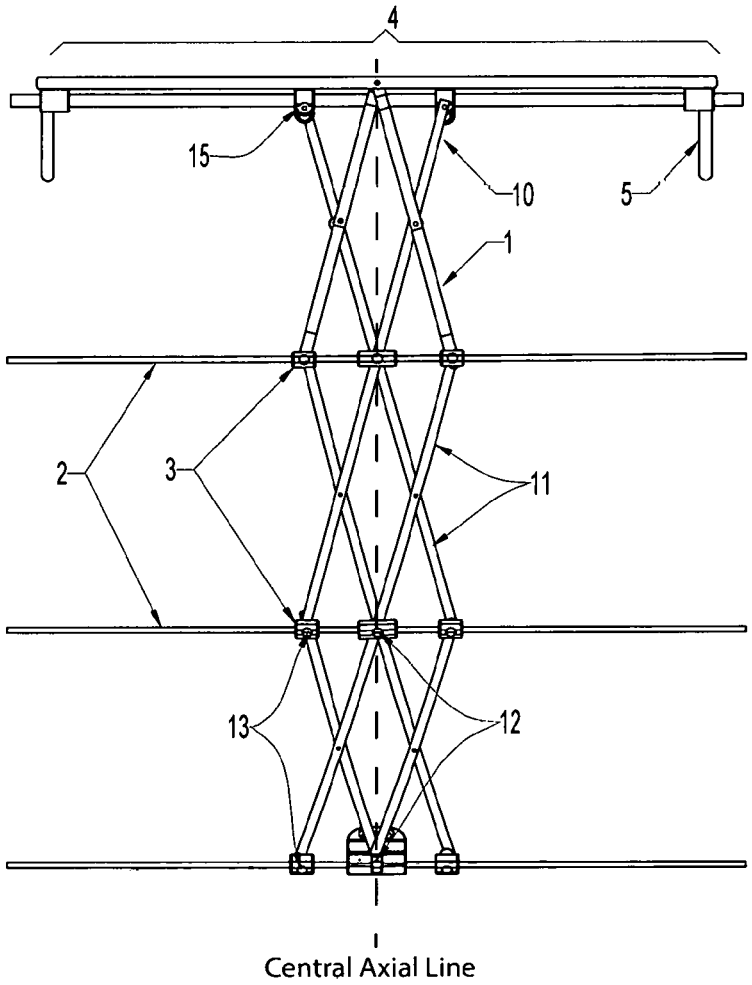
FIG. 2 show a top view of the expandable canopy tent frame.

Referring now to FIGS. 1 to 7, the expandable canopy tent frame and the main structure includes two sets of four-bar linkage with overlapping central axial lines. These are the first linkage set 1 and the second linkage set 10. The four-bar linkage sets are formed by pairs of cross-hinged bars 11 set into parallelograms that can expand along the central axial line. The hinge point on the central axial line is the central axial hinge point 12. The hinge points on two side edges are side hinge points 13. As shown in FIG. 2, because the central axial hinge point 12 is blocked by the plastic structure that hinges to the cross bar 2 and because side hinge points 2 are blocked by slide bushings 3 that position cross bar 2, the position given in the figure is for central axial hinge point 12 and side edge hinge point 13, and not the plastic structure in the above figure.

The central axial lines of the first linkage set 1 and the second linkage set 10 overlap and are staggered. The central axial hinge point 12 of the first linkage set 1 is aligned with the side edge hinge point 13 of the second linkage set 10. The central axial hinge point 12 of the second linkage set 10 is aligned with the side edge hinge point 13 of the first linkage set 1.

The central axial hinge points 12 have a lateral bar 2. The two ends of the lateral bar 2 pass through the slide bushings 3 on the side edge hinge points 13, and the slide bushings form the support with both sides of the lateral bar 2. The cross bar 2 can support a wider area. Because the middle point of the cross bar 2 is hinged to the central axial hinge point 12, it can maintain the balance between both sides. When contracted, the slide bushings 3 on the side edge hinge points 13 can slide along the cross bar 2 and will not obstruct the expansion of the main structure. Therefore, the cross bar 2 can be made of round fiberglass bars to maintain appropriate support strength and light weight.

The main structure of the canopy tent frame has at least one fixed end 4 and can be fixed on objects by utilizing that fixed end, such as on fixed structures on walls or vertical bars.

Furthermore, there are hinge points on the bars 11 that are interconnected between the first linkage set 1 and the second linkage set 10. This enhances the connection between the two sets of bars and strengthens the main structure, without obstructing the expansion.

Figure 5:
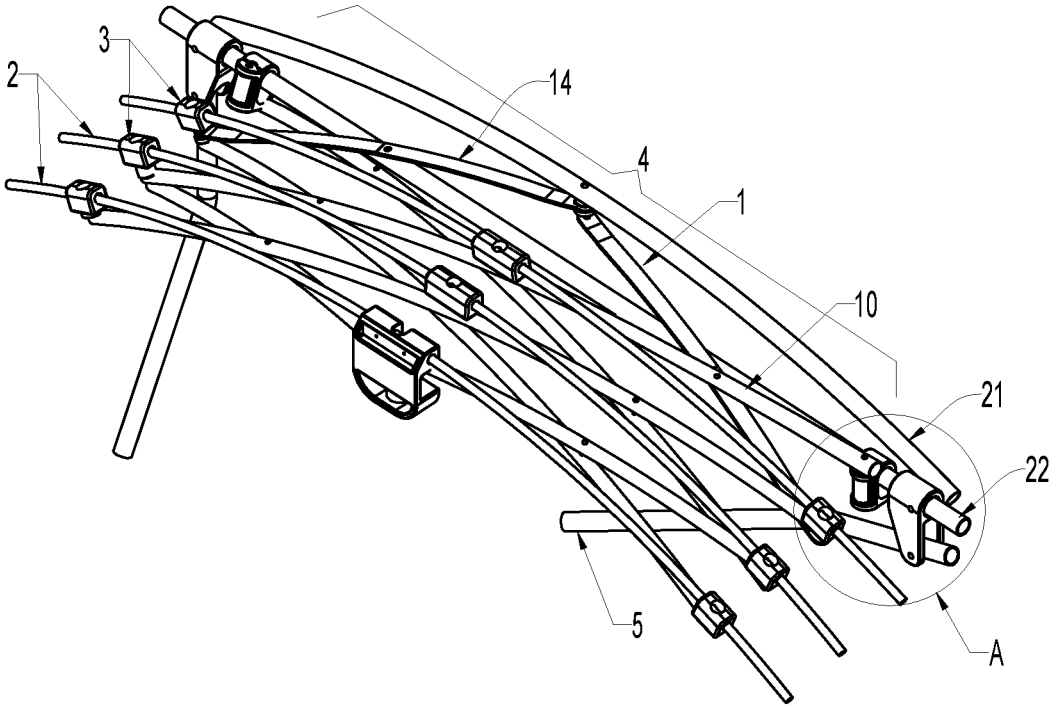
FIG. 5 shows the general appearance of contracted expandable canopy tent frame.
Figure 6:
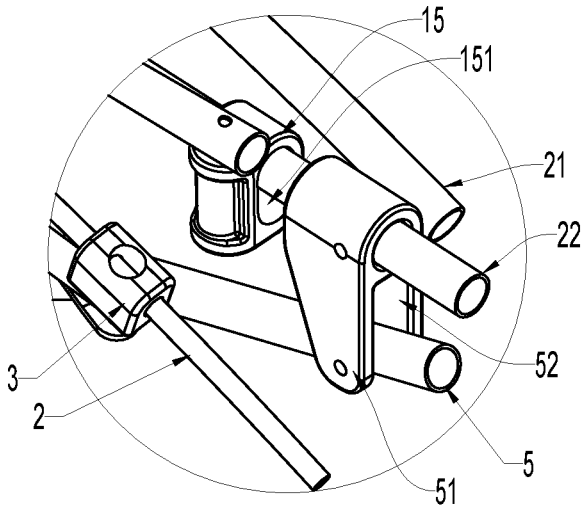
FIG. 6 is a zoomed image of section A from FIG. 5.
Figure 7:
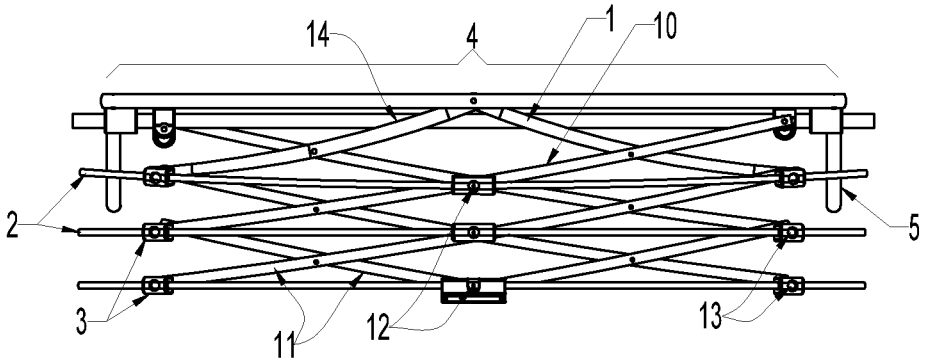
FIG. 7 is a top view of the contracted expandable canopy tent frame.

Furthermore, the fixed end of the main structure is a double cross bar structure. It has an upper cross bar 21 and a lower cross bar 22 that are locked as one structure. The central axial hinge point 12 of the first linkage set 1 and the side edge hinge point 13 of the second linkage set 10 are selectively positioned on the upper cross bar 21 and the lower cross bar 22. In other words, the ends of the first linkage set 1 and second linkage set 10 are positioned corresponding to the upper and lower cross bars. From a side view, they are fixed to form a triangular support, so that the suspension is more secure and stable, as shown in FIGS. 5 and 6.

Figure 3:
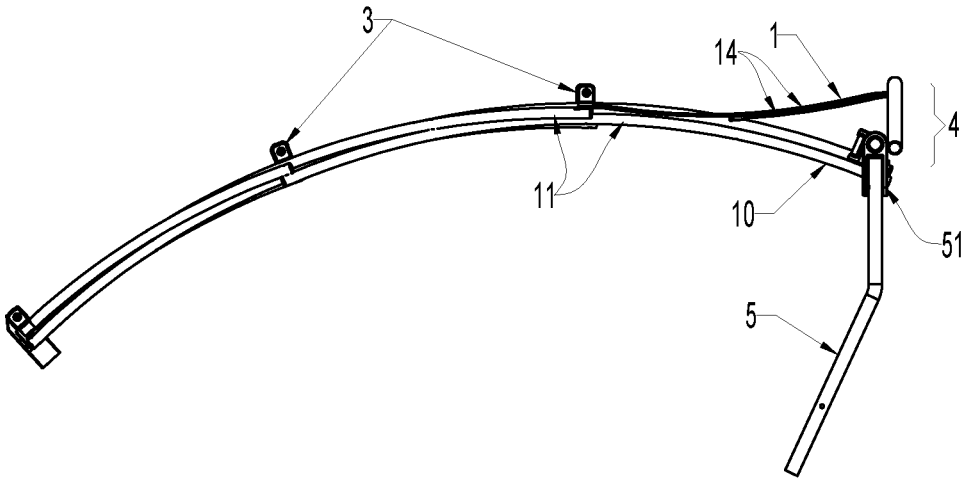
FIG. 3 shows a side view of the expanded expandable canopy tent frame.
Figure 4:
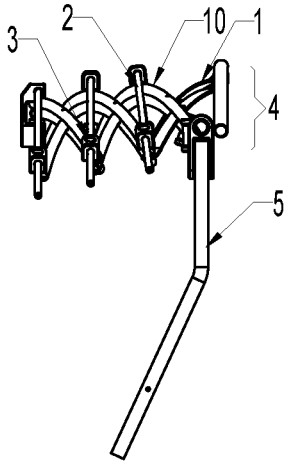
FIG. 4 is a side view of the contracted expandable canopy tent frame.

More specifically, in the fixed end of the main structure, the lower cross bar 22 is primary and the upper cross bar is secondary 21. The side edge linkage point 13 and the second linkage set 10 positioned by the lower cross bar 22 is the primary bar set. The cross-section of bars 11 that form the linkage set is round. Round bars 11 have an even, distributed strength and a large weight-bearing capacity. A wider support can be obtained by using two separate side edge hinge points 13 on the fixed ends. The first linkage set 1 is the secondary bar set; the cross-section of this set and the two bars hinged to the upper cross bar are flat, i.e., flat bars 14 are used. All other bars have a round cross-section and are the same profile as the second linkage set 10. A pair of flat bars 14 are used at the fixed ends of the first linkage set 1. It has good transformation ability. When there is a wider designed space between the upper cross bar 21 and the lower cross bar 22, the transformation capability can be utilized to open and close the position. The larger the designed space between the upper cross bar 21 and the lower cross bar 22, the superior the suspension and wind resistance effects are, as shown in FIGS. 1, 3, and 4.

Conversely, upper cross bar 21 can be used as the primary bar and the lower cross bar 22 as secondary. The second linkage set 10 can be used as the primary bar set and hinge to upper bar 21, while the first linkage set 1 can be used as the secondary bar set and hinge to the lower cross bar 22. This uses the pair of flat bars 14 of the first linkage set to form support at the bottom.

In this example, the upper cross bar 21 forms an upward curve structure, and the two ends hinge to the lower cross bar 2. Only bending is needed, without excessive processing. There is only one hinge point between the upper cross bar 21 and the first linkage set 1. Thus, the upper cross bar 21 can also be replaced with a short bar or plastic structure that stands vertical at the middle of the lower cross bar 22. Similarly, it can also point downward and hinge to the single hinge point at the bottom.

To summarize, in the fixed end, the vertical bar must be used on the primary lower cross bar or upper cross bar, so that the two side edge hinge points 13 in the second linkage set can slide on the straight bar and complete the expansion motion. The secondary upper cross bar or lower cross bar can have a straight bar, a curved bar, or a fixed point, but a curved bar is preferred, so that the two ends directly hinge to the straight bar and can maintain a complete vertical surface at the fixed end. The next preferred bar is the straight bar, and its two ends require additional plastic structures to fix. The single fixed point is the simplest, but it only retains a bar as the fixed end, which is too flexible and difficult to maintain a fixed angle.

In addition to the upper cross bar 21 that forms an upwardly curved structure, the bars 11 in the first linkage set 1 and second linkage set 10 are also curved. The upper cross bar 21 is also curved, and the curvature is similar to that of the bars 11 in the first linkage set and the second linkage set, and they curve upwardly when contracted to the target position. And when expanded, the main structure is also curved along the central axial direction, as shown in FIG. 5. It allows water to slide off, can prevent being blown over by wind, and the curve appearance is also aesthetically pleasing.

Moreover, the side edge hinge point 13 of the second linkage set 10 is positioned with the lower cross bar 22, which means it is fixed on the lower cross bar 22 with a bar bushing 15, and the two bar 11 ends of the second linkage set 10 hinge to their corresponding bar bushings 15. The bar bushings 15 have long slots 151. They can move up and down relative to the lower cross bar 22 and can adapt to the position change of the bar ends.

Furthermore, the fixed end 4 of the main structure has a suspended structure. The suspended structure is described below:

1. A support bar 5, and a pair of plastic structures 51 are fixed at symmetric positions of the upper cross bar 21 of the lower cross bar 22. The back of each plastic structure has a curved slot 52, and the support bar 5 is hinged to the lower end of the central axial line of the curved slot 52. The support bar 5 can open outwardly and can fit into the curved slot 52 to form a vertical stopper. When it closes inwards, it can close with the lower cross bar 22 together. An expandable canopy tent frame with support bars 5 is very suitable for using on a foldable chair or foldable bed. It uses two support bars 5 that directly insert into backrest bars or pipes on the headboard to achieve a configuration that can be taken apart, which meeting the needs for shading against sunshine or rain while sitting or lying down.

2. A plastic structure with insertion holes. The insertion holes of the plastic structure face downwards and are fixed on the upper cross bar 21 or the lower cross bar 22. The plastic structure is fixed on the upper ends of vertical bars. Opposite to the usage status mentioned above, vertical bars need to be reserved on fixed objects. The downward-facing holes of the plastic structure are directly installed to the upper ends of the vertical bars to form a support position, meeting the needs for landscape canopies at fixed scenarios such as patios and walkways.

3. A positioning plate with bolt holes. The positioning plate is fixed between the upper and lower cross bars, and the positioning plate is directly used to fix onto the surface of objects such as vertical walls to serve as an entrance canopy.

In addition to having a fixed end 4 at one end, the main structure of the expandable canopy tent frame can have fixed ends at both ends. After expanding, both ends can get corresponding support to maximize the expanded range of the main structure for use as a tent or as an outdoor shade.

We claim:

1. An expandable canopy tent frame, including:

a first and second four-bar linkage set, each of the first and second four-bar linkage set comprises four cross-hinged bars arranged in two pairs;

a central axial line having first and second central axis hinge points, wherein the central axial line is along a centerline of expansion of the four-bar linkage sets;

each said four-bar linkage set of four cross-hinged bars are connected by four hinges, namely, a top and bottom central axial hinge along said central axial line, and two side hinges;

each four-bar linkage set having a central axis along said central axial line, wherein the first four-bar linkage set overlaps the second four-bar linkage set;

wherein the top hinge from the first four-bar linkage set is mounted on a lateral bar with the two side hinges from the second four-bar linkage set by slide bushings, and wherein the bottom hinge from the second four-bar set is mounted on a lateral bar with the two side hinges from said first four-bar linkage set by slide bushings;

the first linkage set and second linkage set are mirror images of each other; and the tent frame has at least one fixed end and can be fixed on objects by utilizing that fixed end.

2. The expandable canopy tent frame of claim 1, wherein: the at least one fixed end of the tent frame is a double cross bar structure having an upper cross bar and a lower cross bar that are locked as one unitary structure; and the central axial hinge point of the first linkage set and a third side hinge on the second four-bar linkage set are selectively positioned on the upper cross bar and the lower cross bar.

3. The expandable canopy tent frame of claim 2, wherein a fourth side linkage hinge and the second four-bar linkage set are mounted on the lower cross bar.

4. The expandable canopy tent frame of claim 3, wherein the cross-hinged bars in the first linkage set and second linkage set are curved; and the upper cross bar and lower cross bar are parallel straight bars.

5. The expandable canopy tent frame of claim 3, wherein the cross-hinged bars in the first linkage set and second linkage set are curved; the upper cross bar is curved and the curvature is substantially the same as the cross-hinged bars in the first linkage set and the second linkage set, and they curve upward when contracted to the target position.

6. The expandable canopy tent frame of claim 3, wherein the at least one fixed end provides for a suspended structure; and the suspended structure is a plastic structure with insertion holes; the insertion holes of the plastic structure face downwardly and are fixed on the upper cross bar or the lower cross bar; the plastic structure is fixed on the upper ends of vertical bars.

7. The expandable canopy tent frame of claim 3, wherein the at least one fixed end provides for a suspended structure; and the suspended structure is a support bar, and a pair of plastic structures are fixed at symmetric positions of the upper cross bar of the lower cross bar; the back of each plastic structure has a curved slot, and the support bar is hinged to the lower end of the central axial line of the curved slot; the support bar can open outward, and can fit into the curved slot to form a vertical stopper, wherein when it closes inward, it can close with the lower cross bar together.

8. The expandable canopy tent frame of claim 3, wherein a side edge hinge point of the second four-bar linkage set is positioned on the lower cross bar, whereby it is fixed on the lower cross bar with a bar bushing, and the two bar ends of the second linkage set hinge to their corresponding bar bushings; and the bar bushings have long slots and can move up and down relative to the lower cross bar, and can adapt to the position change of the bar ends.

9. The expandable canopy tent frame of claim 2, wherein the cross bars are round bars made of fiberglass.

10. The expandable canopy tent frame of claim 1, wherein there are hinge points on the cross-hinged bars that are interconnected between the first linkage set and the second linkage set.

* * * * *